US008336515B2

(12) United States Patent
Jainek et al.

(10) Patent No.: US 8,336,515 B2
(45) Date of Patent: Dec. 25, 2012

(54) OIL COOLER OIL PUMP ASSEMBLY FOR AN INTERNAL COMBUSTION ENGINE

(75) Inventors: Herbert Jainek, Heilbronn (DE); Thomas Jessberger, Asperg (DE); Axel Kravanja, Böbingen (DE)

(73) Assignee: Mann + Hummel GmbH, Ludwigsburg (DE)

( * ) Notice: Subject to any disclaimer, the term of this patent is extended or adjusted under 35 U.S.C. 154(b) by 646 days.

(21) Appl. No.: 12/539,649

(22) Filed: Aug. 12, 2009

(65) Prior Publication Data

US 2010/0037849 A1 Feb. 18, 2010

(30) Foreign Application Priority Data

Aug. 14, 2008 (DE) ..... 20 2008 010 864 U

(51) Int. Cl.
*F01M 1/02* (2006.01)
*F01M 5/00* (2006.01)

(52) U.S. Cl. ..... 123/196 AB; 123/41.33; 123/196 R; 184/6.4

(58) Field of Classification Search ..... 123/195 C, 123/196 R, 196 A, 196 AB, 41.33; 184/6.4
See application file for complete search history.

(56) References Cited

U.S. PATENT DOCUMENTS

| | | | | |
|---|---|---|---|---|
| 5,934,241 | A | 8/1999 | Von Esebeck | |
| 6,267,094 | B1 | 7/2001 | Kuettner et al. | |
| 6,561,155 | B1 * | 5/2003 | Williams | 123/196 S |
| 7,398,858 | B2 | 7/2008 | Bicker et al. | |
| 2005/0023200 | A1 | 2/2005 | Ueshima et al. | |
| 2005/0193965 | A1 | 9/2005 | Takemoto et al. | |
| 2007/0068479 | A1 | 3/2007 | Matsuda | |

FOREIGN PATENT DOCUMENTS

| | | |
|---|---|---|
| DE | 19619977 | 12/1997 |
| DE | 19739668 | 3/1999 |
| DE | 102006032795 | 1/2006 |
| EP | 0807748 | 11/1997 |
| EP | 1016776 | 7/2000 |
| EP | 1433931 | 6/2004 |
| EP | 1503050 | 2/2005 |
| JP | 10176515 | 6/1998 |
| JP | 11017728 | 4/1999 |
| JP | 2001065323 | 3/2001 |
| WO | WO2005113948 | 12/2005 |

OTHER PUBLICATIONS

EP search report for related application EP09167633, dated Oct. 7, 2009.

German patent office search report in priority application DE202008010864.0.

* cited by examiner

*Primary Examiner* — Noah Kamen
(74) *Attorney, Agent, or Firm* — Jim Hasselbeck

(57) ABSTRACT

An oil cooler oil pump assembly for an internal combustion engine has an oil cooler and an oil pump configured to draw in oil from the oil pan and convey it to the oil cooler. The oil cooler is arranged on the exterior side of the oil pan. The oil pump is integrated into the oil pan, wherein oil pump and oil cooler are immediately or closely coupled to one another by a connecting pipe.

14 Claims, 2 Drawing Sheets

OIL COOLER OIL PUMP ASSEMBLY FOR AN INTERNAL COMBUSTION ENGINE

CROSS REFERENCE TO RELATED APPLICATIONS

Priority is claimed based on Federal Republic of Germany utility model application DE 202008010864.0 filed on Aug. 14, 2008.

TECHNICAL FIELD

This disclosure relates to an oil cooler oil pump assembly for an internal combustion engine.

BACKGROUND OF THE INVENTION

DE 197 39 668 A1 discloses an oil pump module that combines in a common assembly an oil pump, an oil cooler, and an oil filter. The oil cooler is disposed in a plastic housing; the oil pump is laterally flanged to the plastic housing. The oil pump module is pressed by means of the plastic housing against the crankcase of an internal combustion engine and is driven by it.

Such oil pump modules draw in oil from an oil pan and convey it to the oil cooler and an oil filter arranged downstream of the oil cooler from where the cooled and filtered oil is guided to the lubrication sites of the engine.

Generally, in regard to the oil circulation a pressure loss as small as possible is to be maintained in order to keep the drive power for the oil pump and the correlated fuel consumption as minimal as possible. Pressure losses in the oil circulation are generated, for example, by long oil conduits and by deflections.

The invention has the object to reduce pressure losses in the oil cooler oil pump assembly for internal combustion engines.

SUMMARY OF THE INVENTION

This object is solved according to the invention with the features of claim 1. The dependent claims disclose expedient further embodiments.

In the oil cooler oil pump assembly according to the invention for an internal combustion engine, the oil cooler and the oil pump are arranged outside and inside an oil pan, respectively, which oil pan is placed underneath the crankcase of the internal combustion engine. Oil pump and oil cooler are located at different sides of the wall of the oil pan and are connected to one another by a connecting pipe. As a result of the integration of the oil pump into the oil pan, the oil that is contained within the oil sump of the oil pan is drawn into the pump in on the shortest possible path by the oil pump and is guided by means of the connecting pipe to the oil cooler on the exterior side of the oil pan. The connecting pipe extends preferably through a cutout in the oil pan wall wherein basically embodiments are also conceivable in which the connecting pipe is arranged in the area of the front edge of the oil pan wall. The oil cooler is located expediently immediately on the exterior side of the oil pan in order to keep the paths that are to be traveled by the oil from the oil sump to the oil cooler as small as possible.

The attachment of the oil cooler on the exterior side of the oil pan is realized preferably by means of a flange plate at the oil cooler through which also the connecting pipe is passed. The connecting pipe extends thus through the wall of the oil pan as well as through the flange plate. In an arrangement of the oil pump in immediate neighborhood to that oil pan wall on whose exterior side the oil cooler is arranged a shortest possible configuration of the connecting pipe can be realized. The connecting pipe is in particular embodied to have a straight configuration in order to avoid pressure losses caused by deflections.

The oil pump has a suction pipe for drawing in oil from the oil sump of the oil pan wherein the oil suction pipe expediently is integrated into the housing of the oil pump and is formed as an integral part thereof. The oil pump housing and the oil suction pipe are comprised preferably of light metal such as aluminum. An oil screen can be introduced into the oil suction pipe in the area of the free end at the end face.

The oil suction pipe projects preferably at a slant downwardly into the oil sump so that the drawn-in oil is conveyed from the pump unit of the oil pump at a slant upwardly to an outlet socket that is connected to the connecting pipe. The connecting pipe that is preferably of a straight configuration extends in particular horizontally between oil pump and oil cooler. In this way, at least when traveling on a flat road it is ensured that the oil pump must not perform conveying work for overcoming vertical height within the connecting pipe.

The oil pump is preferably embodied as a gear pump; however, basically other types of pumps are conceivable also.

For attaching the oil pump to the oil pan, a fastening flange is formed integrally with the oil pump housing and is connected to an oil pan wall on an inner side of the oil pan, in particular in the area of the pan bottom or a step that is formed in the oil pan. Possible is also an attachment of the fastening flange on the inner side of the oil pan wall on whose exterior side the oil cooler is arranged.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
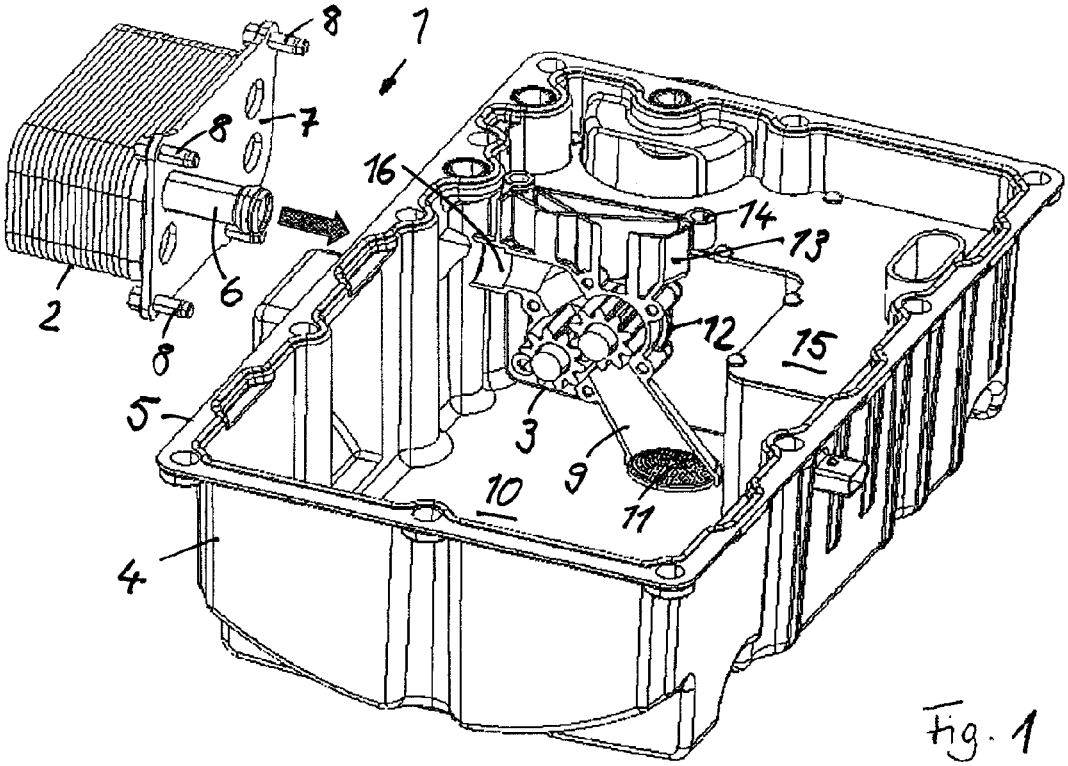
FIG. 1 is a perspective view an oil pan on which an oil cooler oil pump assembly is arranged, comprised of an oil cooler on the exterior side of the pan and an oil pump in the interior of the pan.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to an oil cooler oil pump assembly for an internal combustion engine oil as disclosed herein. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

In FIG. 1 an oil cooler oil pump assembly 1 is illustrated that comprises an oil cooler 2 and an oil pump 3 and is arranging on and in the oil pan 4 of an internal combustion engine. The oil cooler 2 is mounted on the exterior side of the boundary wall 5 of the oil pan 4. The oil pump 3 is located in the interior of the oil pan 4. By means of connecting pipe 6 that is embodied integrally or unitarily with the oil cooler 2 and extends horizontally through the boundary wall 5 of the oil pan 4, the oil cooler 2 and the oil pump 3 are connected to one another.

The oil cooler 2 has a planar flange plate 7 with which the oil cooler 2 is attached to the exterior side of the boundary wall 5. The flange plate 7 also receives the connecting pipe 6 that is embodied in particular unitarily with the flange plate 7. On the flange plate 7 fastening elements 8 are arranged that are embodied as screws and with which the flange plate 7 is mounted on the exterior side of the boundary wall 5. In the mounted position the flange plate 7 is parallel to the exterior side of the boundary wall 5 wherein in a regular traveling situation on flat ground the flange plate 7 extends in a vertical plane so that the connecting pipe 6 that projects perpendicularly to the plane from the flange plate 7 is in a horizontal position. This has the advantage that on flat ground no height difference must be overcome by the connecting pipe 6.

The oil pump 3 in the interior of the oil pan 4 has an oil suction pipe 9 which is embodied in particular unitarily with the oil pump housing wherein the oil pump housing and oil suction pipe 9 are preferably comprised of a light metal such as aluminum. The free end of the oil suction pipe 9 is oriented toward the bottom 10 of the oil pan 4 that in operation forms an oil sump with oil received therein. In the area of the free end face an oil screen 11 is integrated into the oil suction pipe 9.

A fastening flange 13 is formed integrally with the oil pump housing 12 by means of which the oil pump 3 is to be connected to the oil pan 4. In the upper area of the fastening flange 13 there are integrally formed fastening sockets 14 for receiving fastening elements, for example, screws, with which the fastening flange is to be attached to a raised step 15 of the oil pan. The step 15 extends angularly in the interior of the oil pan, the topside of the step 15 is positioned underneath, i.e., at an axial spacing to the end face of the circumferentially extending boundary wall of the oil pan, but also higher than the bottom 10 of the oil pan. In some embodiments the raised step 15 may be positioned in a spaced parallel relationship to the bottom 10 of the oil pan.

Figure 2:
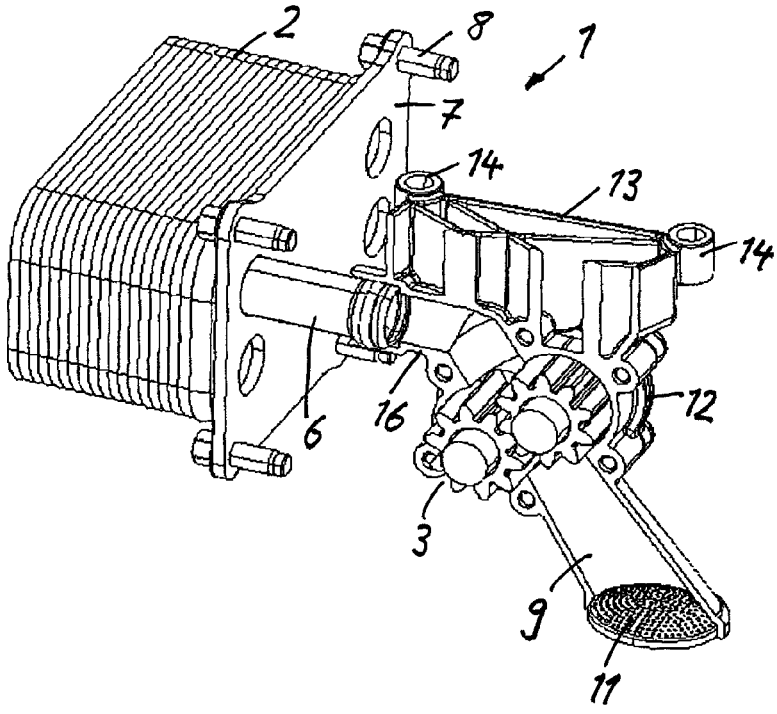
FIG. 2 in an individual representation the oil cooler oil pump assembly in the connected state of oil cooler and oil pump.
Figure 3:
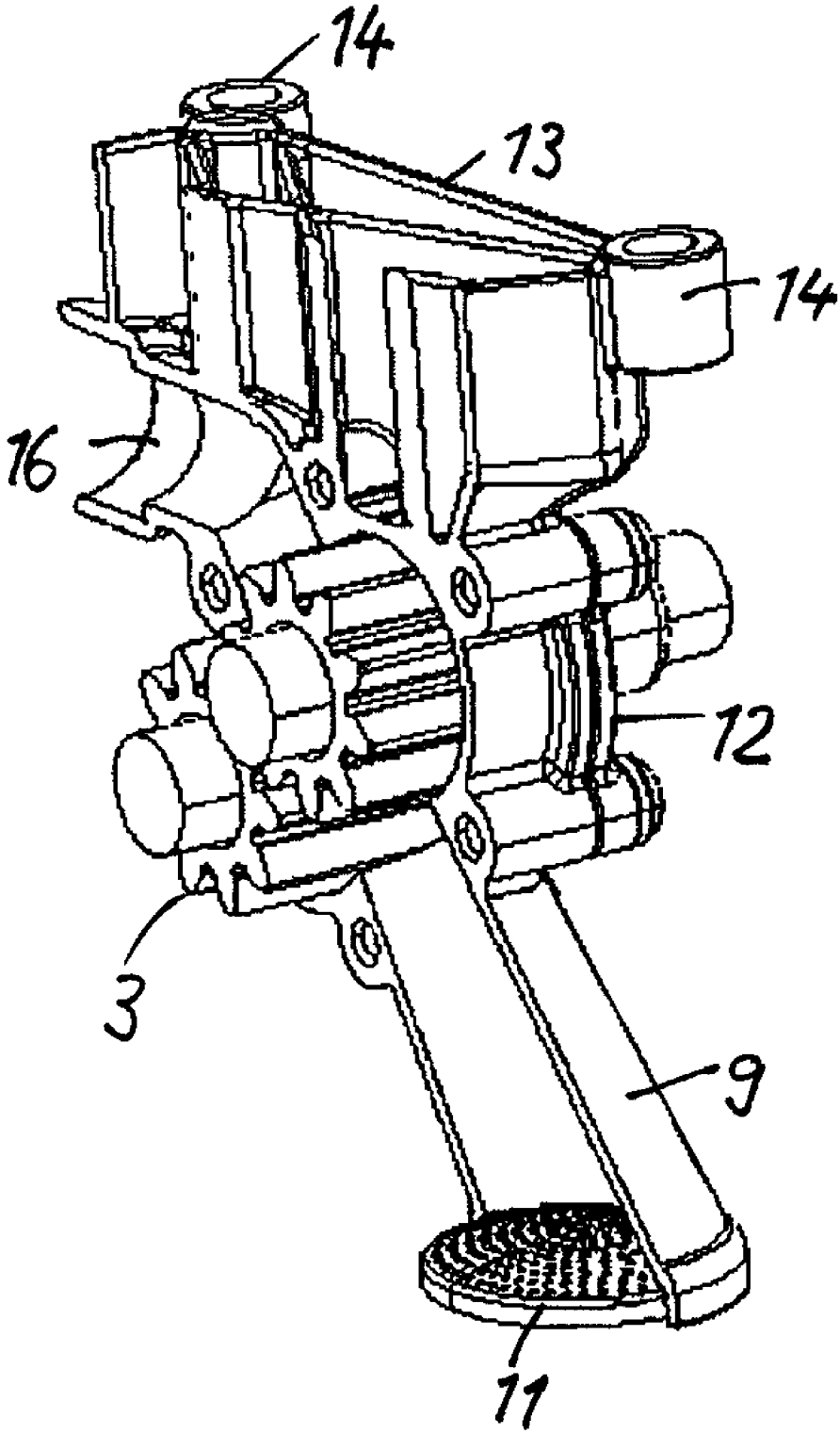
FIG. 3 is a perspective illustration of the oil pump.

As can be seen in FIG. 1 in connection with FIG. 2 and FIG. 3, the pipe socket 16 is formed integrally with the oil pump housing 12 of the oil pump 3, embodied as a gear pump, on the side that is facing the connecting pipe 6 wherein the pipe socket 16 is embodied as an angled socket and in the mounted position (FIG. 2) is connected to the connecting pipe 6. The pipe socket 16 compensates the angle between the slanted downwardly oriented oil suction pipe 9 and the horizontal connecting pipe 6. This angle is within an angular range between 0 degrees and 90 degrees, preferably between 20 to 80 degrees, and more preferably at substantially 45 degrees. The free end face of the pipe socket 16 is provided with a wider diameter into which the connecting pipe 6 can be inserted. In the position mounted in the oil pan the oil pump 3 is adjacent to the boundary wall 5 on whose exterior side the oil cooler 2 is arranged. This has the advantage that relatively short pipe lengths are sufficient for the connecting pipe 6 and the pipe socket 16.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. Oil cooler oil pump assembly for an internal combustion engine, comprising an oil cooler (2); and an oil pump (3) configured to draw in oil from an oil pan (4) of the internal combustion engine and convey it to the oil cooler (2);

wherein the oil cooler (2) is arranged on an exterior side of the oil pan (4) and the oil pump (3) is integrated into an interior of the oil pan (4); and wherein the oil pump (3) and the oil cooler (2) are closely coupled with one another by a connecting pipe (6);

wherein the connecting pipe (6) is embodied as an integral part of the oil cooler (2);

wherein the oil cooler (2) further includes a flange plate (7) configured for attachment to the exterior side of the oil pan (4);

wherein the connecting pipe (6) extends through the flange plate (7);

wherein the oil pump (3) has correlated therewith an oil suction pipe (9) for drawing in oil from the oil pan (4);

wherein the oil suction pipe (9) is integrated into the oil pump housing (12) and is formed integrally with the oil pump housing (12);

wherein a fastening flange (13) is formed integrally with the oil pump housing (12), said fastening flange including integrally formed fastening sockets (14); and wherein the oil pump (3) is connected to the inner side of the oil pan (4) by the fastening flange of the oil pump (3).

2. Oil cooler oil pump assembly according to claim 1, wherein the connecting pipe (6) is embodied to have a straight configuration.

3. Oil cooler oil pump assembly according to claim 2, wherein the connecting pipe (6) extends horizontally between oil pump (3) and oil cooler (2).

4. Oil cooler oil pump assembly according to claim 3, wherein the oil suction pipe (9) includes an oil screen (11).

5. Oil cooler oil pump assembly according to claim 4, wherein the oil pump housing (12) and the oil suction pipe (9) are made of aluminum.

6. Oil cooler oil pump assembly according to claim 2, wherein the oil pump (3) and the oil cooler (2) are arranged on opposite sides of the wall (5) of the oil pan (4).

7. Oil cooler oil pump assembly according to claim 6, wherein said oil pump fastening flange is connected to and supported by a raised step arranged within said oil pan, said raised step positioned in a spaced parallel relationship to the bottom of the oil pan and positioned below an upper end face of a boundary wall of the oil pan.

8. Oil cooler oil pump assembly according to claim 6, wherein said suction pipe is slanted downwardly from said oil pump relative to said connecting pipe at an angle of between 20 to 80 degrees, said downwardly slanted angle reducing a deflection angle imposed on pumped oil flow; and wherein a discharge of said oil pump includes an angled socket (16) configured to connect to said connecting pipe (6) and angled to compensate for said downwardly slanted angle.

9. Oil cooler oil pump assembly for an internal combustion engine, comprising an oil cooler (2); and an oil pump (3) configured to draw in oil from an oil pan (4) of the internal combustion engine and convey it to the oil cooler (2);

wherein the oil cooler (2) is arranged on an exterior side of the oil pan (4) and the oil pump (3) is integrated into an interior of the oil pan (4);

wherein the oil pump (3) and the oil cooler (2) are closely coupled with one another by a connecting pipe (6);

wherein the connecting pipe (6) is embodied as an integral part of the oil cooler (2);

wherein the connecting pipe (6) is embodied to have a straight configuration;

wherein the connecting pipe (6) extends horizontally between oil pump (3) and oil cooler (2);

wherein the oil cooler (2) further includes a flange plate (7) configured for attachment to the exterior side of the oil pan (4);

wherein the connecting pipe (6) extends through the flange plate (7);

wherein the oil pump (3) has correlated therewith an oil suction pipe (9) for drawing in oil from the oil pan (4);

wherein the oil suction pipe (9) is integrated into the oil pump housing (12) and is formed integrally with the oil pump housing (12);

wherein the oil suction pipe (9) includes an oil screen (11);

wherein the oil pump housing (12) and the oil suction pipe (9) are made of aluminum;

wherein a fastening flange (13) is formed integrally with the oil pump housing (12); and wherein the oil pump (3) is connected to the inner side of the oil pan (4) by the fastening flange of the oil pump (3).

10. Oil cooler oil pump assembly according to claim 9, wherein the oil pump (3) and the oil cooler (2) are arranged on opposite sides of the wall (5) of the oil pan (4).

11. Oil cooler oil pump assembly according to claim 10, wherein the oil pump (3) is embodied as a gear pump.

12. Oil cooler oil pump assembly according to claim 11, wherein said oil pump fastening flange is connected to and supported by a raised step arranged within said oil pan, said raised step positioned in a spaced parallel relationship to the bottom of the oil pan and positioned below an upper end face of a boundary wall of the oil pan.

13. Oil cooler oil pump assembly according to claim 12, wherein said suction pipe is slanted downwardly from said oil pump relative to said connecting pipe at an angle of between 20 to 80 degrees, said downwardly slanted angle reducing a deflection angle imposed on pumped oil flow; and wherein a discharge of said oil pump includes an angled socket (16) configured to connect to said connecting pipe (6) and angled to compensate for said downwardly slanted angle.

14. Oil cooler oil pump assembly according to claim 13, wherein said downwardly slanted angle is substantially 45 degrees.

* * * * *